United States Patent [19]

Tikhonov et al.

[11] Patent Number: 4,628,678

[45] Date of Patent: Dec. 16, 1986

[54] TWISTING MEMBER OF RINGLESS SPINNING APPARATUS

[75] Inventors: Valentin N. Tikhonov; Gennady V. Zhigalov; Abdurakhim Abduganiev; Vladimir K. Dulnev, all of Tashkent, U.S.S.R.

[73] Assignee: Tashkentskoe Spetsialnoe Konstruktorskoe Bjuro Textilnykh Mashin, Tashkent, U.S.S.R.

[21] Appl. No.: 780,091

[22] Filed: Sep. 25, 1985

[51] Int. Cl.[4] ..... D01H 7/882

[52] U.S. Cl. ..... 57/400; 57/331; 57/334; 57/337; 57/339; 57/401

[58] Field of Search ..... 57/400, 331, 401, 334, 57/404, 414, 337–339

[56] References Cited

U.S. PATENT DOCUMENTS 3,877,211 4/1975 Saveliev et al. ..... 57/404
4,285,192 8/1981 Saveliev et al. ..... 57/400

FOREIGN PATENT DOCUMENTS 484269 9/1975 U.S.S.R. .
630315 10/1978 U.S.S.R. .
941445 7/1982 U.S.S.R. .

*Primary Examiner*—John Petrakes
*Attorney, Agent, or Firm*—Lilling & Greenspan

[57] ABSTRACT

A twisting member of a ringless spinning apparatus comprises a cylindrical housing with blades on its peripheral side surface. Secured on the blades is a first disc with an eccentric passage extending therethrough for the advancement of fibres, this disc acting as one gripping element of a device for gripping the fibres. The other gripping element is in the form of a second disc with an axial passage which is coaxially mounted on one end of a spring-biased sleeve in a position facing the first disc with the eccentrically extending passage and defining a gap with this first disc. The sleeve is coaxially accommodated in the housing.

2 Claims, 1 Drawing Figure

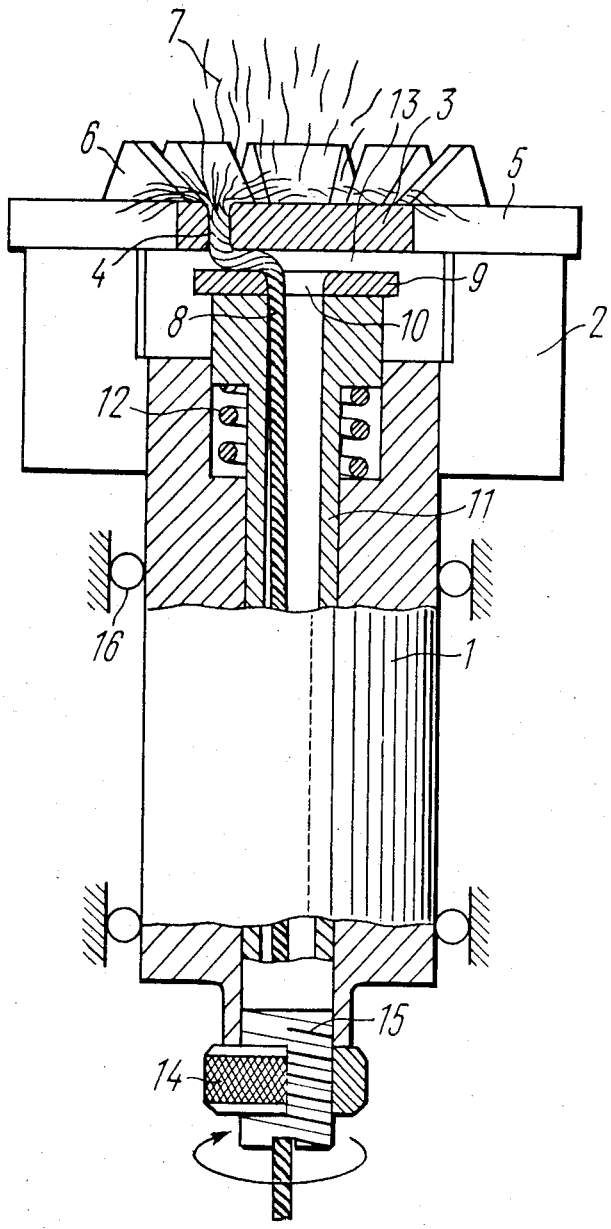
7
13
3
6
5
4
9
8
10
2
12
11
16
1
15
14

TWISTING MEMBER OF RINGLESS SPINNING APPARATUS

FIELD OF THE INVENTION

The invention relates to textile engineering, and more particularly it relates to a twisting member for a ringless yarn-spinning apparatus.

BACKGROUND OF THE INVENTION

There exist, at present, various techniques of gripping or holding fibres in twisting members of ringless spinning apparatus, determining the design of the fibre-gripping device. Thus, there are employed twisting members comprising a cylindrical housing with blades on the side surface thereof, supporting a disc with a through-going passage for the advancement of fibres, and a fibre-gripping device including a spring-biased sleeve accommodated within the housing coaxially therewith; however, the performance of these members is characterized by a relatively high rate of yarn breakage due to the fact that the yarn is being formed from individual fibres which display low cohesion to one another until they are twisted into the yarn, and if the degree of twist defining the strength of the yarn proves to be insufficient, breakage takes place. The degree of twist, in its turn, is mainly dependent on the technique and effort of gripping the fibres in the twisting member, i.e. it is ultimately dependent on the design of the fibre-gripping device.

The requirements put before the gripping of fibres in the twisting member are such that, on the one hand, the gripping effort should be sufficient to impart to the fibres the necessary twist and to produce yarn of adequate strength, while, on the other hand, the effort should not be excessive, so that the formed yarn could pass through the gripping device either freely or with the necessary tension, so as to avoid the production of overtwisted yarn necessitating the addition of several extra operations in its further processing.

There is known a twisting member of a ringless spinning apparatus, comprising a cylindrical housing with blades on the side surface thereof, supporting a disc with a through-going axial passage for the advance of fibres, and a fibre-gripping device including gripping elements and a spring-biased sleeve accommodated within the housing coaxially therewith. One of the gripping elements is in the form of a ball received partly in a recess made in the end of the spring-biased sleeve and urged by this sleeve against the axial passage of the disc, the latter acting as the second gripping element (cf. SU Inventor's Certificate No. 484,269; Int.Cl.$^3$ DO1H 1/12, filed in 1973).

This twisting member is distinguished in that the gripping of fibres by the ball takes place simultaneously in two zones, i.e. the first one between the disc and the ball and the second one between the ball and the sleeve. The existence of the two gripping zones gives rise to considerable resistance to the propagation of the twist through the axial passage of the disc toward the outer surface thereof where the process of joining the fibres to the end of the yarn takes place, so that the process is prone to instability, the fibres are poorly twisted intermediate the two gripping zones, and in case of some impurity or a strand of unseparated fibres coming in, the joining process is interrupted, and breakage occurs.

There is further known a twisting member basically similar to the above/described one, wherein the passage through the disc extends eccentrically and at an inclination angle with respect to the axis of the disc, so that the ball is urged against the disc without closing the outlet of this through-going passage (cf. SU Inventor's Certificate No. 941,445; Int.Cl.$^3$ DO1H 7/885, dated 1982).

This twisting member is devoid of the gripping zone between the disc and the ball, which provides for easier propagation of the twist into the fibre-joining zone, and for a reduced breakage rate. However, should a piece of impurity or a strand of unseparated fibres find its way into the fibre-advancing passage and thus step up the yarn tension, the ball can be pushed away from its socket and driven by centrifugal forces toward the periphery of the disc, which, firstly, affects the gripping of fibres between the spring-biased sleeve and the ball, thus leading to the yield of substandard yarn, and, secondly, unbalances the twisting member, thus causing vibration and rapid wear of its bearings.

There is further known a twisting member of a ringless yarn-spinning apparatus, likewise comprising a cylindrical housing with blades on the side surface thereof, supporting a disc with an eccentrically extending passage for the advance of fibres, and a fibre-gripping device with two gripping elements, including a spring-biased sleeve mounted in the housing coaxially therewith (cf. SU Inventor's Certificate No. 630,615; Int.Cl.$^3$ DO1H 1/12, published in 1978).

In this twisting member one of the gripping elements is in the form of a projection on the disc shaped as a body of revolution concentric with the disc, the passage in the disc also extending through the projection. The other gripping element is the end face of the spring-biased sleeve, urged against the projection.

The last-described twisting member provides for obtaining yarn of a higher quality, owing to the stable gripping of fibres, and for avoiding vibration at higher speeds in the operation of the apparatus.

However, the increased distance from the zone of joining the fibres to the yarn on the outer surface of the disc to the fibre-gripping zone, due to the extended length of the through passage in the disc and its projection, affects the control over the fibres in this portion of the path of the yarn, and of shorter fibres, in particular. In other words, over such a prolonged portion commensurate with the fibre length, the probability of reliable gripping and spinning-in of a fibre at both ends—one end in the joining zone and other end in the gripping zone—is seriously impaired, and when one end of a certain fibre is loosely engaged, the fibre is prone to become separated from the bulk of the fibres by the air stream moving through the twisting member and to be carried away. Consequently, a large proportion of fibres, particularly, shorter ones, is carried into the waste, which affects the yield of yarn. Furthermore, the "fast" gripping of the fibres between the projection and the sleeve results in the leaping tension of the yarn when a piece of impurity or a strand of fibres enters the gripping zone, causing yarn breakage.

It should also be mentioned that the manufacture of a twisting member with a stationary projection on the inner surface of the disc and a channel extending through the disc and the projection involves a relatively complicated procedure, as long as the popular technique of making parts of this kind is casting with subsequent machining.

SUMMARY OF THE INVENTION

It is an object of the present invention to create a twisting member of a ringless spinning apparatus, providing a reduced rate of yarn breakage and loss of fibre, and also providing a simplified manufacturing technology of this member.

This object is attained in a twisting member of a ringless spinning apparatus, comprising a cylindrical housing with blades on the side surface thereof, supporting a disc with an eccentrically extending passage for the advance of fibres, and a device for gripping the fibres. The gripping device includes two gripping elements and a spring-biased sleeve which are coaxially accommodated in the housing. One gripping element is in the form of a disc with an axial passage which is fixed coaxially on one end of the spring-biased sleeve facing a second disc with an eccentrically extending passage. A gap is defined between the discs with the eccentrically extending passage functions as the second gripping element.

The twisting member should include a means for adjusting the gap between the discs which is attached to the spring-biased sleeve.

With one gripping element of the fibre-gripping device being in the form of a disc having an axial passage and mounted to define a gap between it and the other disc acting as the second gripping element, the rate of yarn breakage can be significantly reduced and the productivity of the ringless spinning apparatus can be raised accordingly. Moreover, the operation of the ringless spinning apparatus becomes easier and more stable and the yarn quality is enhanced, owing to the fact that the yarn has fewer joints of broken ends. Furthermore, the reduced length of the no-control portion in the path of the fibres from the joining zone to the zone of gripping between the discs appreciably decreases the loss of fibres, thus stepping up the yield of standard yarn.

The herein disclosed twisting member is simple to manufacture, owing to the simple and straightforward structure of the fibre-gripping device formed by two flat discs.

BRIEF DESCRIPTION OF THE DRAWINGS

The sole FIGURE is a longitudinal view in partial section, of a twisting member of the ringless spinning apparatus.

DETAILED DISCLOSURE OF THE INVENTION

The twisting member of a ringless spinning apparatus comprises a vertically positioned cylindrical housing 1 with blades 2 uniformly spaced on the peripheral side surface of this housing 1 and extending along its generatrix to define the impeller of the fan of the twisting member. A disc 3 is mounted on the top ends of the blades 2, with a passage 4 extending through this disc 3 eccentrically with respect to its axis of rotation. The disc 3 further has radially extending slits 5 made therethrough, these slits 5 being uniformly angularly spaced and serving for the passage of the stream of air generated by the impeller blades 2 when the housing 1 is rotated. The disc 3 had on its top surface a plurality of spaced projections 6 for retaining individual fibres 7 at the surface of this disc 3 until they are joined to the end of the yarn 8 being formed, the fibres 7 passing through the passage 4 in the process of joining.

The twisting member further comprises a device for gripping the fibres 7, made up of two gripping elements, of which one is the disc 3 and the other gripping element is in the form of a disc 9 with an axially extending passage 10 for the advance of fibres. The disc 9 is secured in any suitable known manner on the end of a spring-biased sleeve 11, facing the disc 3, coaxially.

The sleeve 11 is designed for vertical or axial adjustment. Axial adjustment is accomplished when the sleeve 11 is moved to one side of the housing 1 under the action of a spring 12 and to a second side due to the effect of the thicker portions of the yarn strands 8 in the bore in the housing 1. A disc 9 is coaxially mounted to the sleeve 11 in the housing and is paired with a disc 3 to define a gap 13. The depth of the gap 13 is adjustable to correspond to the type of fibres being handled (i.e. natural or man-made) and to the yarn's thickness. Thus, the disc 9 attached to the sleeve 11 is moveable relative to a surface of the disc 3.

With the fibre-gripping device being in the form of the two flat discs, the manufacturing technology of the twisting member, as a whole, is simplified.

When the parameters of the yarn being produced are varied, it is essential to vary the value of the gap 13 between the discs 3 and 9, for which purpose the twisting member incorporates the gap adjusting means associated with the spring-biased sleeve 11. In the embodiment being described the gap-adjusting means is in the form of a nut 14 adjustable along the helical thread 15 cut on the opposite end of the spring-biased sleeve 11, the nut 14 abutting against the adjacent end of the housing 1. The nut 14 is locked against inadvertent rotation in any suitable known manner.

The housing 1 is journalled in bearings 16 for rotation from any known friction-type drive (not shown), e.g. using driving belts or tapes.

The disc 9 can be made integral with the sleeve 11; however, this construction precludes swift replacement of the disc 9 when it becomes worn in service, and prohibits making the disc 9 of a material more wear-resistant than the material of the sleeve 11, although this could be highly expedient as the axial passage 10 of the disc 9 is subject to intense wear at its certain portion by the yarn 8 which simultaneously rotates at a relatively high speed and also advances axially at a high velocity.

The width of the annular working surface of the disc 9 should be sufficient to provide the adequate friction area for gripping the fibres in accordance with their nature and parameters, and to ensure the required tension of the yarn.

The herein disclosed twisting member of a ringless spinning apparatus operates, as follows.

With the twisting member being rotated in its bearings 16, the separated fibres 7 fed from a fibre-separating device (not shown) onto the surface of the disc 3 in the flow of air passing through the radial slits 5 are deposited onto the portion of this surface of the disc 3, defined by the projections 6, predominantly in the form of radially extending small fibrous ribbons. The ends of these fibrous ribbons also extend into the radial slits 5 intermediate the projections 6. The spinning-in end of the yarn 8 guided in advance to the outer surface of the disc 3 through the axial bore of the sleeve 11, axial passage 10 of the disc 9 and eccentrically arranged passage 4 of the disc 3 revolves about its axis and sweeps the surface of the disc 3, engaging the fibres 7 deposited onto this surface and drawing them through the passage 4 into the fibre-gripping device, i.e. into the gap 13 between the discs 3 and 9. The fibres 7 are imparted with the major part of the twist which, owing to the existence of the gap 13, freely propagates to the outer surface of the disc 3, thus promoting reliable engagement of the subsequent fibres 7. Should some impurity or a strand of unseparated fibres find its way into the fibres 7 being fed, the latter would carry it through the gripping device, the existence of the gap 13 ensuring that the tension of the yarn 8 rises but slightly, and no breakage occurs. Thus, the herein disclosed twisting member provides for significant reduction of the yarn breakage rate. Moreover, as the length of the portion where the fibres are under control from their engagement zone on the surface of the disc 3 to the gripping zone between the discs 3 and 9 is determined by the length of the passage 4, i.e., by the thickness of the disc 3, which is not commensurate with the fibre length, the process of engaging the fibres 7 and spinning them into the yarn 8 is marked by a high degree of probability, which reduces the loss of fibres and steps up the yield of yarn.

The fibres 7 twisted together in the gripping device between the discs 3 and 9 advance subsequently into the sleeve 11 where the final twist is imparted and subsequently transformed into the yarn 8 which leaves the sleeve 11 to be taken up by the winding unit (not shown).

When the parameters of the fibres and the thickness of the yarn to be produced are varied, the nut 14 is released from its retaining means and adjusted along the thread 15, thus causing axial displacement of the sleeve 11 and varying accordingly the value of the gap 13, making it either greater or smaller, as the case may be. When the required value of the gap 13 is set, the nut 14 is retained once again on the thread 15.

What is claimed is:

1. A twisting member of a ringless spinning apparatus, comprising:

a cylindrical housing having a peripheral side surface;

blades being accommodated on said peripheral side surface of said cylindrical housing;

a first disc being secured on said blades and having a passage extending through said first disc in an eccentric direction relative to an axis of rotation of said first disc, said passage advancing fibres of yarn through said first disc;

a spring-biased sleeve accommodated inside said housing in a coaxial direction relative to a longitudinal axis of said housing; and a second disc having an axial passage extending through said second disc in a direction substantially parallel to said eccentric direction of said passage of said first disc, and said passage of said second disc advancing said fibres of said yarn through said second disc, said second disc being mounted on a first end of said sleeve in a coaxial position relative to said sleeve, whereby a first side of said second disc faces a first side of said first disc and said first side of said second disc and said first side of said first disc defining a gap and forming a means for gripping said fibres of said yarn.

2. A twisting member according to claim 1 further comprising:

means for adjusting said gap between said first and second discs, said adjusting means being associated with said sleeve.

* * * * *